United States Patent [19]

Call

[11] Patent Number: 4,561,548

[45] Date of Patent: Dec. 31, 1985

[54] KNIFE HOLDER WITH FRONTAL SLOTS

[75] Inventor: Daniel D. Call, Athens, Wis.

[73] Assignee: Oy Fiskars AB, Helsinki, Finland

[21] Appl. No.: 580,884

[22] Filed: Feb. 16, 1984

Related U.S. Application Data

[63] Continuation of Ser. No. 459,478, Jan. 20, 1983, abandoned.

[51] Int. Cl.[4] ..... A47F 1/04; A47F 1/00; A47G 21/14

[52] U.S. Cl. ..... 211/70.7; 248/37.3; 312/128

[58] Field of Search ..... D7/73, 74; 248/37.3, 248/37.6; 211/70.7; 312/128

[56] References Cited

U.S. PATENT DOCUMENTS

| | | | |
|---|---|---|---|
| D. 146,222 | 1/1947 | Hvale | D7/74 |
| D. 196,250 | 9/1963 | Hamermick | D7/74 |
| D. 216,475 | 1/1970 | Everburg | D7/74 |
| D. 240,496 | 7/1976 | Schultz et al. | D7/74 |
| D. 255,007 | 5/1980 | Pallotta, Jr. et al. | D7/74 |
| D. 266,136 | 9/1982 | Peabody | D7/74 |
| 1,946,779 | 2/1934 | Conway | 248/37.3 |
| 2,291,381 | 7/1942 | Drake | D7/74 |
| 3,980,608 | 9/1976 | Faltersack | 248/37.3 |
| 4,071,212 | 1/1978 | Burrows et al. | 248/37.6 |

FOREIGN PATENT DOCUMENTS

| | | | |
|---|---|---|---|
| 2450582 | 11/1980 | France | 248/37.6 |

OTHER PUBLICATIONS

"Schaner Wohnen" in *Messersefs* Mar./Apr. 1978, pp. SW225.

*Primary Examiner*—Paul A. Bell
*Assistant Examiner*—Paul M. Heyrana, Sr.
*Attorney, Agent, or Firm*—James E. Nilles; Thomas F. Kirby

[57] ABSTRACT

A knife holder for removably supporting kitchen knives, each having a handle and a blade, is adapted to rest on a table or counter or hang on a wall. The holder includes an upwardly sloped upper surface, a generally vertical front surface, a plurality of slots extending inwardly from these two surfaces, and an obstruction near the lower end of the slots so that the length of the interior portion of a slot at least equals the length of a knife blade, whereas the frontal portion of a slot (down to the obstruction) is shorter than the knife blade. A knife handle engaging projection is located adjacent the upper end of each slot to prevent accidental slippage of a knife from a slot. When a knife is supported in a slot, the blade tip is behind and below the obstruction, and the knife handle rests on the upper surface of the holder behind the handle engaging projection. The knife is removed by raising it vertically in the slot until the handle clears the projection and until the blade tip clears the obstruction, and then moving it forwardly out through the front of the slot. The holder is also provided with one or more implement-receiving slots extending horizontally thereinto from a side thereof for storing a scissors, a knife, a sharpener or other implement.

10 Claims, 14 Drawing Figures

KNIFE HOLDER WITH FRONTAL SLOTS

This application is a continuation, of application Ser. No. 459,478, filed Jan. 20, 1983. now abandoned.

BACKGROUND OF THE INVENTION

1. Field of Use

This invention relates generally to knife holders having blade-receiving slots therein for removably supporting kitchen knives.

2. Description of the Prior Art

The prior art contains many examples of knife holders adapted to rest on a supporting surface, such as a table or counter, or adapted to be hung on a wall near a work center in a kitchen. Such prior art knife holders typically comprise a body having an upper surface from which knife-blade-receiving slots extend into the body. The upper surface is either horizontal, with vertical slots extending into the body, or slanted, with vertically sloped slots extending into the body, and, when a knife is inserted into a slot, that end of the knife handle from which the knife blade extends rests on or against the upper surface. The length of each slot is equal to or greater than the length of the blade of a knife to be supported therein and, as a result, when a knife is to be removed from the block, it must be withdrawn along the slot axis until the tip of the blade clears the upper end of the slot on the upper surface of the block. As a result, knife holders of the aforesaid character cannot be usefully located beneath a cabinet or shelf unless the clearance between the upper end of a knife handle and the underside of the cabinet or shelf is greater than the minimum distance the blade of a knife supported in the holder needs to be raised vertically to clear the upper end of the slot during removal, for example.

The following U.S. Patents illustrate the state of the art: U.S. Pat. Nos. 2,955,789; 2,338,303; 1,746,503; 2,495,866; 2,238,324; 2,924,410; 2,517,972; 2,413,169.

SUMMARY OF THE PRESENT INVENTION

In accordance with the present invention there is provided an improved knife holder having a plurality of slots for removably supporting a plurality of kitchen knives or the like which are of different sizes and shapes. The knife holder as adapted to rest on a surface such as a kitchen counter or table or to hang on a wall adjacent a work center in a kitchen. The knife holder is adapted for removably supporting knives of a type having a handle and a blade (thinner than the handle) extending from one end of the handle. The knife holder generally comprises a body having an upper surface, a front surface transverse to the upper surface, and a plurality of generally vertical blade-receiving slots extending inwardly into the body from both surfaces. Each slot has an interior portion at least as long as the knife blade it receives and an exposed frontal portion which is closer to the front surface of the body than is the interior portion of the slot. Blade obstructing means are located near the lower end of each slot at or near the exposed frontal portion of the slot. The distance between the upper surface of the body and the blade obstructing means is less than the length of the knife blade. Knife handle engaging means are located alongside the upper end of each slot, preferably in the form of a projection formed on the upper surface of the body.

In use, a knife blade is inserted into the frontal portion of the slot just high enough to clear the obstructing means, and then the knife blade tip is slid behind the obstructing means and the knife handle is brought to rest against the upper surface of the body behind the handle engaging means. A knife is removed by raising it until the handle clears the handle engaging means and until the blade tip clears the obstructing means, whereupon the knife may be tilted or moved horizontally (with tip downward) through the frontal portion of the slot.

In some embodiments, the knife holder is also adapted to removably support an implement, such as another knife, a pair of scissors, a sharpener, or the like, and is, therefore, provided with one or more implement-receiving slots extending inwardly from a side of the body.

A knife holder in accordance with the invention offers several advantages over the prior art. For example, since a knife need not be moved vertically for a distance equivalent to the length of its blade during insertion or removal from the holder, such actions are easier to accomplish. Furthermore, such a knife holder may be located or hung beneath a wall-mounted cabinet which has less clearance than would otherwise be needed to accommodate most types of prior art knife holders. The knife holder employs handle engaging means which ensures that a knife does not inadvertently or accidentally slide out of the holder through the frontal portion of the slot. The knife holder may employ a horizontally arranged implement receiving slot which enhances its utility and, since no vertical clearance is needed for this slot, the aforementioned clearance problem is avoided. The knife holder takes the form of an article of manufacture which can be fabricated of several pre-shaped components, such as pieces of wood or plastic, which are secured together by adhesives, nails, screws or other fastening means; or can be fabricated as a one-piece or integral piece of molded plastic. Other objects and advantages of the invention will hereinafter appear.

DRAWINGS

DESCRIPTION OF PREFERRED EMBODIMENTS

Figure 3:
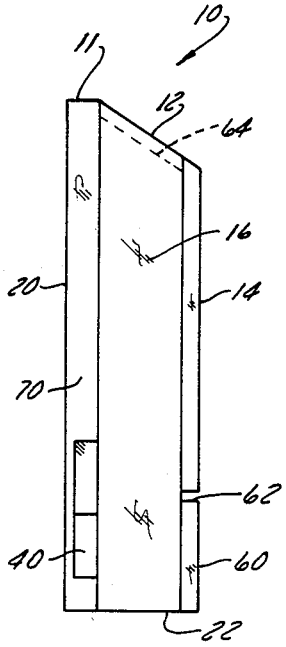
FIG. 3 is a side elevation view of the holder of FIG. 1.
Figure 1:
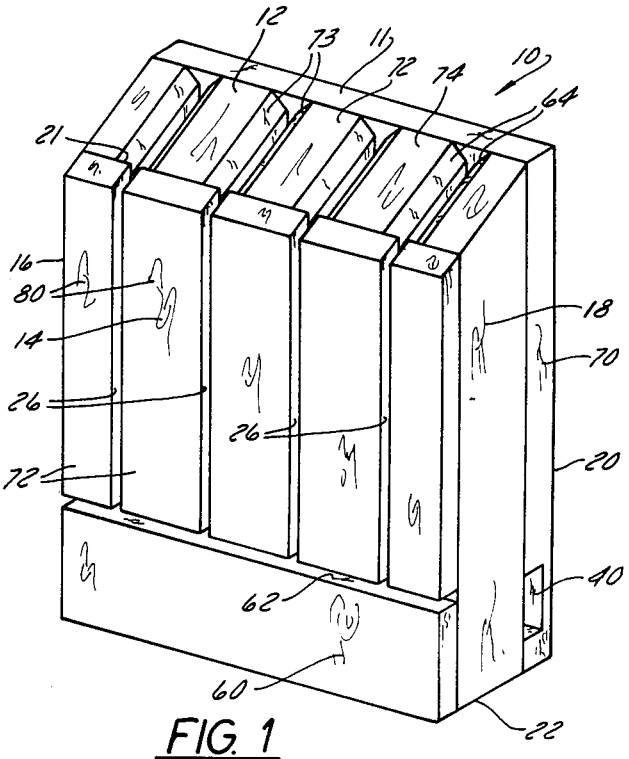
FIG. 1 is a perspective view of the front surface, upper surface and a side surface of a first embodiment of a knife holder in accordance with the invention.

FIGS. 1 through 4 pertain to a first embodiment designated 10 of the invention; FIGS. 5 through 8 to a second embodiment 210; FIGS. 9 through 12 to a third embodiment 310; and FIGS. 13 and 14 to a fourth embodiment 410. In the following description and accompanying drawings, similar components in the several embodiments are designated by similar reference numerals.

FIRST EMBODIMENT

Referring to FIGS. 1 through 4, the numeral 10 designates a knife holder in accordance with a first embodiment of the present invention. Holder 10 comprises a body 11 having an upper surface 12, a front surface 14 transverse to upper surface 12, opposite side surfaces 16 and 18, a rear surface 20 and a bottom surface 22. Upper surface 12 slopes upwardly, proceeding rearwardly from the front edge 21 thereof which meets the upper edge of front surface 14. Holder 10 may be supported during use either on a table or counter (not shown) by resting its bottom surface 22 thereon or by hanging it on a wall (not shown) by an attachment means such as a hole 24 in the rear surface 20 of the holder.

Figure 2:
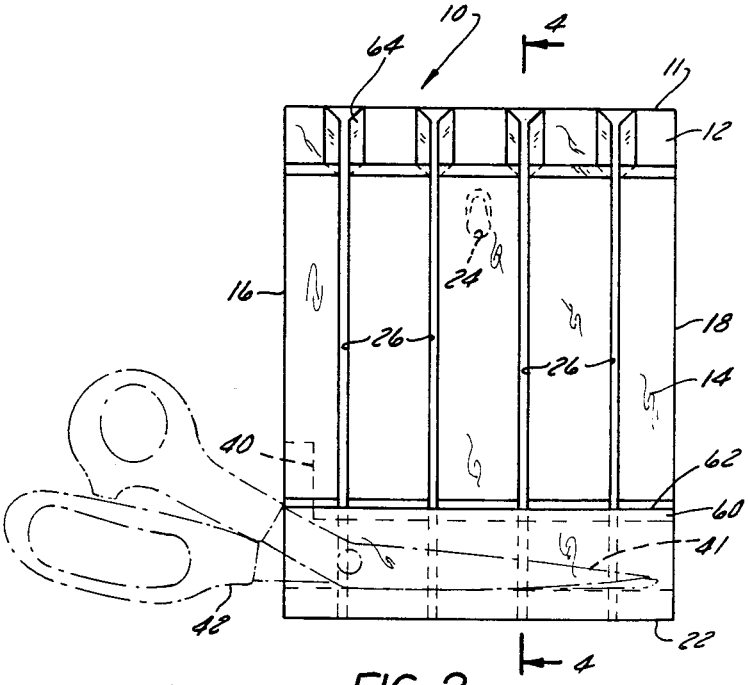
FIG. 2 is a front elevation view of the holder of FIG. 1.
Figure 4:
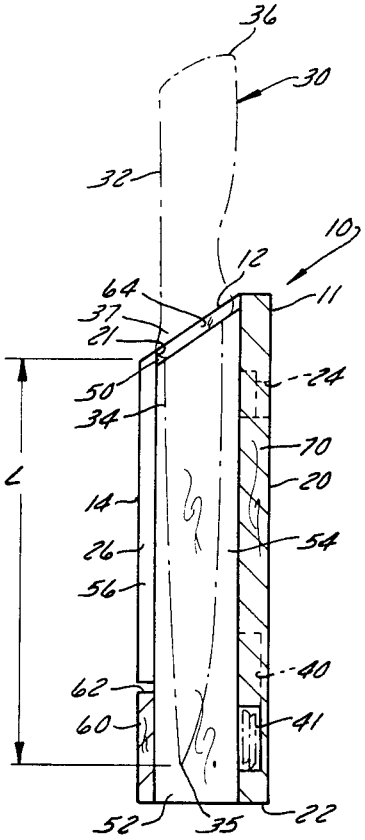
FIG. 4 is a cross-section view taken on line 4—4 of FIG. 2.
Figure 5:
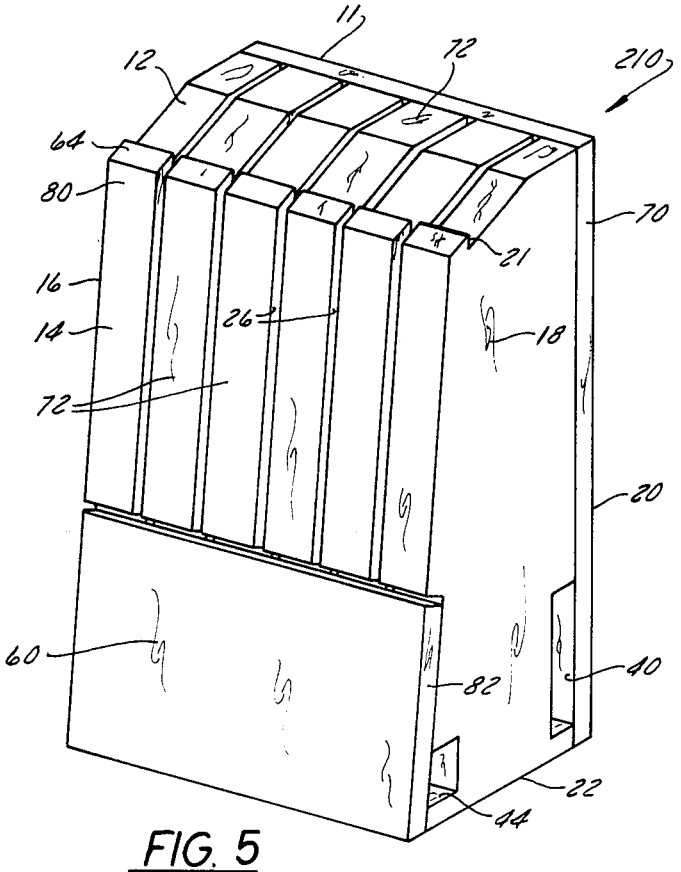
FIG. 5 is a perspective view of the front surface, upper surface and a side surface of a second embodiment of a knife holder in accordance with the invention.
Figure 7:
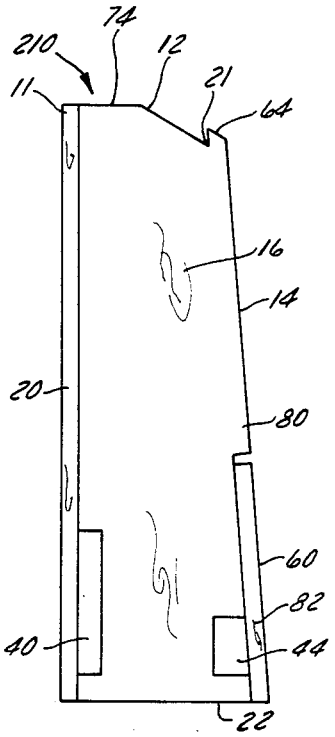
FIG. 7 is a side elevation view of the holder of FIG. 5.
Figure 6:
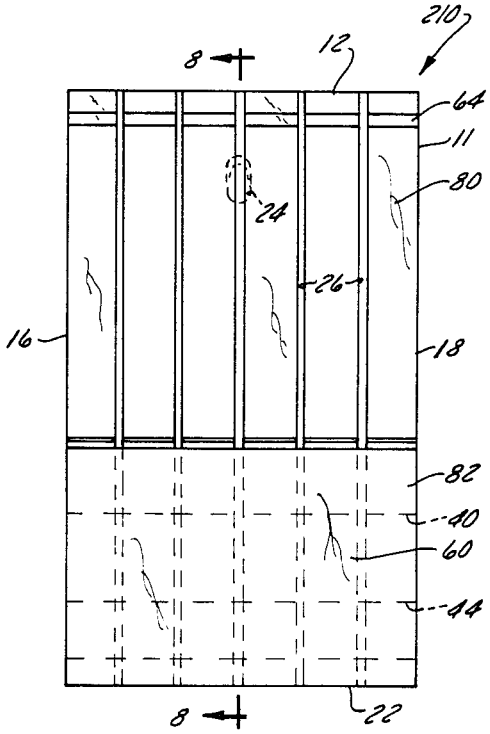
FIG. 6 is a front elevation view of the holder of FIG. 5.
Figure 8:
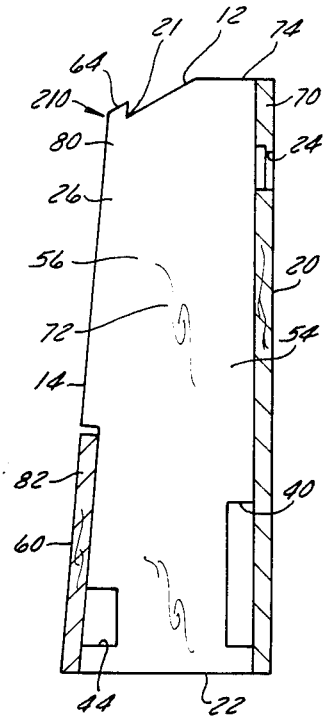
FIG. 8 is a cross-section view taken on line 8—8 of FIG. 6.

Holder 10 comprises a plurality (four) of knife-blade receiving slots, such as slot 26, which extend inwardly from the upper surface 12 and front surface 14 and is thus able to releasably support a plurality (four) of knives, such as the knife 30 shown in FIGS. 2 and 4.

Knife 30 comprises a knife handle 32 and a knife blade 34. Knife handle 32, which is wider and thicker than blade 34, includes a terminal end 36 and an opposite end 37 from which blade 34 extends or projects. As FIGS. 2 and 4 show, the end 37 of handle 32 is sloped and tapered, respectively. Blade 16 has a length L measured from blade tip 35 to the lowermost part of handle end 37.

Holder 10 also comprises an implement receiving slot 40 which extends inwardly from side surface 18 and is adapted to accommodate an implement or a portion thereof in supporting relationship, such as the closed blades 41 or a scissors 42 shown in FIG. 2.

As FIG. 4 shows, blade-receiving slot 26 includes an upper slot end 50, a lower slot end 52, an interior slot portion 54 and an exposed frontal slot portion 56 which is closer to front surface 14 of holder 10 than is the interior slot portion 54. Blade-receiving slot 26, which is shown in FIG. 4 as open at its lower slot end 52, is at least as long as the length L of the knife blade 16 of knife 30.

Blade obstructing means 60 are provided near the lower slot end 52 of blade-receiving slot 26 in front of the interior slot portion 54 and at or near the exposed frontal slot portion 56. The distance between the top side 62 of the blade obstructing means 60 and the upper surface 12 of the body 11 of knife holder 10 adjacent the lowermost part of handle 32 is less than the length L of blade 34 of knife 30.

Handle engagement means in the form of a projection 64 are provided adjacent the upper slot end 50 of blade-receiving slot 26 and near the edge 21 where the upper surface 12 and front surface 14 of body 11 meet or intersect. The handle engagement means 64 engages the end of handle 32 of knife 30 to prevent the latter from sliding and falling forward out of slot 26 when emplaced therein.

Knife holder 10 is employed as follows. Assume that holder 10 is standing on a surface, such as a table or counter (now shown), or is hung on a wall (not shown) by means of hole 24.

To place knife 30 therein, the user grasps the knife handle 32, inserts the top 35 of knife blade 34 in a slot 26 at any position above the obstructing means 60, slides the blade tip downwardly into the slot and into the space or region behind the obstructing means 60, and brings the end 37 of knife handle 32 to rest against the upper surface 12 of body 11 behind the handle engagement means 64 on surface 12, as FIG. 4 shows.

To remove the knife 30, it is necessary to grasp the handle 32 and to raise it vertically until the handle end 37 clears the handle engagement means 64 and then to further raise it vertically (simultaneously tilting the knife forward or counterclockwise with respect to FIG. 4, if desired) until blade tip 35 is above and able to clear the obstructing means 60, whereupon the knife can be withdrawn completely from holder 10 without any further vertical movement.

As FIG. 2 makes clear, the blades 41 of scissors 42 are grasped and axially inserted or withdrawn from slot 40.

The knife holder 10 shown in FIGS. 1 through 4 is shown as constructed of pieces of wood (or possibly plastic) which are cut to appropriate size and shape and connected to one another with an appropriate adhesive (or small nails or brads) at the several joints. Knife holder 10 comprises a back-plate 70 in the form of a single piece of wood having an L-shaped groove or recess cut or routed into the inner surface thereof to define implement receiving slot 40. A series of five spaced apart blocks 72 are attached to the inner surface of back-plate 70 to define four slots 26. Each block 72 has a sloped upper end 74 defining the sloped upper surface 12. Each block 72 has its upper edge adjacent a slot 26 cut away or bevelled as at 73 to match the configuration of the end 37 of the knife holder 32. The blocks 72 are the same height as back-plate 70 on their rear sides. Each block 72 is provided with an attached face plate 80 which is the same width but shorter in length than the block 72 and the upper corner of each face plate 80 adjacent a bevel 73 serves as the handle engagement means 64. A strip of wood 82 extends across the front of the lower ends of the blocks 72, below and in spaced relationship from the face plates 80 to provide the blade obstructing means 60.

SECOND EMBODIMENT

Referring to FIGS. 5 through 8, the numeral 210 designates a knife holder in accordance with a second embodiment of the present invention. Holder 210 also comprises body 11 having an upwardly sloped upper surface 12, a substantially vertical front surface 14 transverse to upper surface 12, opposite side surfaces 16 and 18, a rear surface 20 and a bottom surface 22.

Holder 210 comprises a plurality (five) of knife-blade receiving slots, such as slot 26, which extend inwardly from the upper surface 12 and front surface 14 and is thus able to releasably support a plurality (five) of knives, such as the knife 30 shown in FIGS. 2 and 4.

Holder 210 comprises two implement receiving slots 40 and 44 which extend inwardly from side surface 18 and each is adapted to accommodate an implement or a portion thereof in supporting relationship. Slot 40 is adapted to receive the closed blades 41 of a scissors 42 shown in FIG. 2 and slot 44 is adapted to receive a sharpening stone (not shown), for example.

Blade obstructing means 60 are provided near the lower slot end 52 of blade-receiving slot 26 in front of the interior slot portion 54 and at or near the exposed frontal slot portion 56.

Handle engagement means in the form of a projection 64 are provided adjacent the upper slot end 50 of blade-receiving slot 26 and near the edge 21 where the upper surface 12 and front surface 14 of body 11 meet or intersect.

The knife holder 210 shown in FIGS. 5 through 8 is shown as constructed of pieces of wood (or possibly plastic) which are cut to appropriate size and shape and connected to one another with an appropriate adhesive (or small nails or brads) at the several joints. Knife holder 210 also comprises a back-plate 70 in the form of a single piece of wood. A series of six spaced apart blocks 72 are attached to the inner surface of back-plate 70 to define five slots 26. Each block 72 has a sloped upper end 74 defining the sloped upper surface 12. The blocks 72 are the same height as back-plate 70 on their rear sides. The blocks 72 have grooves or recesses cut or routed into the inner surface thereof to define implement receiving slots 40 and 44. Each block 72 is provided with an integrally formed face plate 80 which is the same width but shorter in length than the block 72 and the upper corner of each face plate 80 adjacent a slot serves as the handle engagement means 64. A strip of wood 82 extends across the front of the lower ends of the blocks 72, below and in spaced relationship from the face plates 80 to provide the blade obstructing means 60.

THIRD EMBODIMENT

Referring to FIGS. 9 through 12, the numeral 310 designates a knife holder in accordance with a third embodiment of the present invention. Holder 310 also comprises a body 11 having an upwardly sloped upper surface 12, a front surface 14 transverse to upper surface 12, opposite side surfaces 16 and 18, a rear surface 20 and a bottom surface 22.

Holder 310 comprises a plurality (five) of knife-blade receiving slots, such as slot 26, which extend inwardly from the upper surface 12 and front surface 14 and is thus able to releasably support a plurality (five) of knives, such as the knife 30 shown in FIGS. 2 and 4. Each slot 26 includes an upper segment 26A, an intermediate segment 26B, and a lower segment 26C.

Holder 310 also comprises two implement receiving slots 40 and 44 which extend inwardly from side surface 18 and is adapted to accommodate an implement or a portion thereof in supporting relationship. Slot 40 may receive the closed blades 41 of a scissors 42 shown in FIG. 2 and slot 44 a sharpener (not shown).

Blade obstructing means 60 are provided near the lower slot end 52 of blade-receiving slot 26 in front of the interior slot portion 54 and at or near the exposed frontal slot portion 56.

Handle engagement means in the form of a projection 64 are provided adjacent the upper slot end 50 of blade-receiving slot 26 and near the edge 21 where the upper surface 12 and front surface 14 of body 11 meet or intersect.

Figure 9:
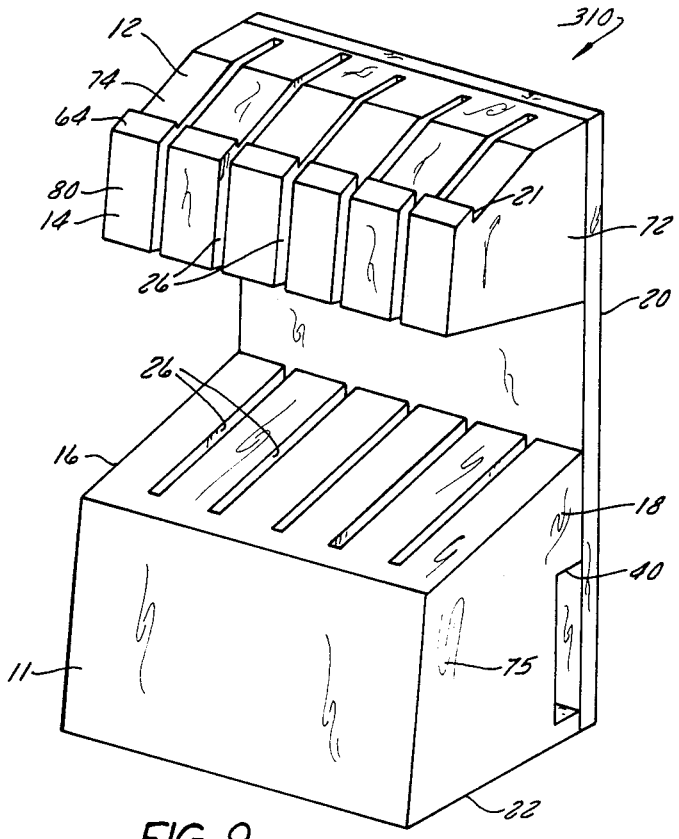
FIG. 9 is a perspective view of the front surface, upper surface and a side surface of a third embodiment of a knife holder in accordance with the invention.
Figure 11:
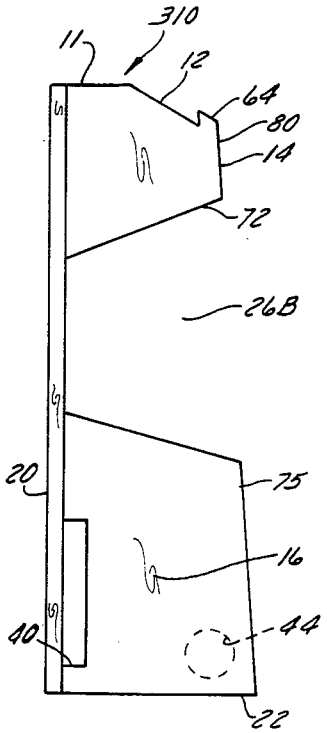
FIG. 11 is a side elevation view of the holder of FIG. 9.
Figure 10:
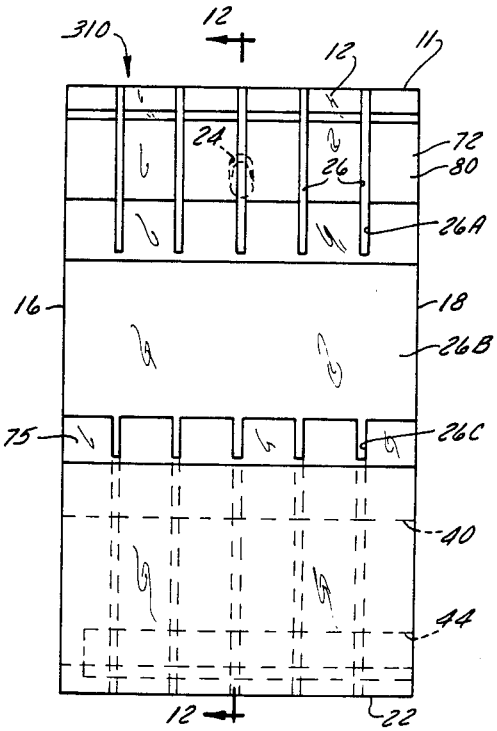
FIG. 10 is a front elevation view of the holder of FIG. 9.
Figure 12:
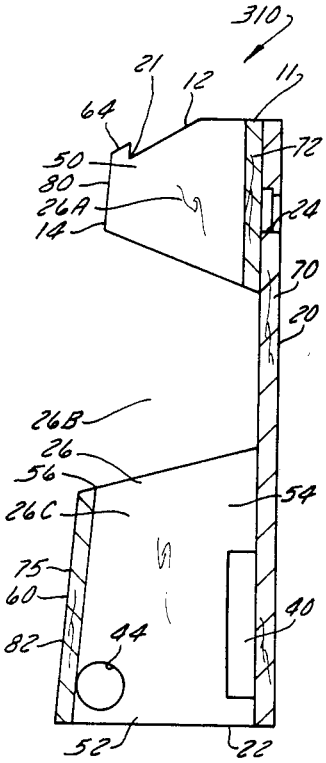
FIG. 12 is a cross-section view taken on line 12—12 of FIG. 10.

The knife holder 310 shown in FIGS. 9 and 12 is shown as constructed of pieces of wood (or possibly plastic) which are cut to appropriate size and shape and connected to one another with an appropriate adhesive (or small nails or brads) at the several joints. Knife holder 310 also comprises a back-plate 70 in the form of a single piece of wood. The lower block has a groove or recess cut or routed into the inner surface thereof to define implement receiving slot 40. An upper block 72 is attached to the inner surface of back-plate 70 and is sawn to define five slot segments 26A. Block 72 has a sloped upper end 74 defining the sloped upper surface 12. Block 72 is shorter than back-plate 70. The upper block 72 defines the upper slot segments 26A. A single lower block 75 is provided with sawn-in lower slot segments 26C. Slot segment 26B is in the space between the upper blocks 72 and lower block 75. Block 72 is provided with an integrally formed face plate 80 which is the same width and the same length as the front of the block 72, and the upper corner of each face plate 80 adjacent a slot serves as the handle engagement means 64. A strip of integral wood 82 extends across the front of the block 75, below and in spaced relationship from the upper blocks 72 to provide the blade obstructing means 60.

FOURTH EMBODIMENT

Figure 13:
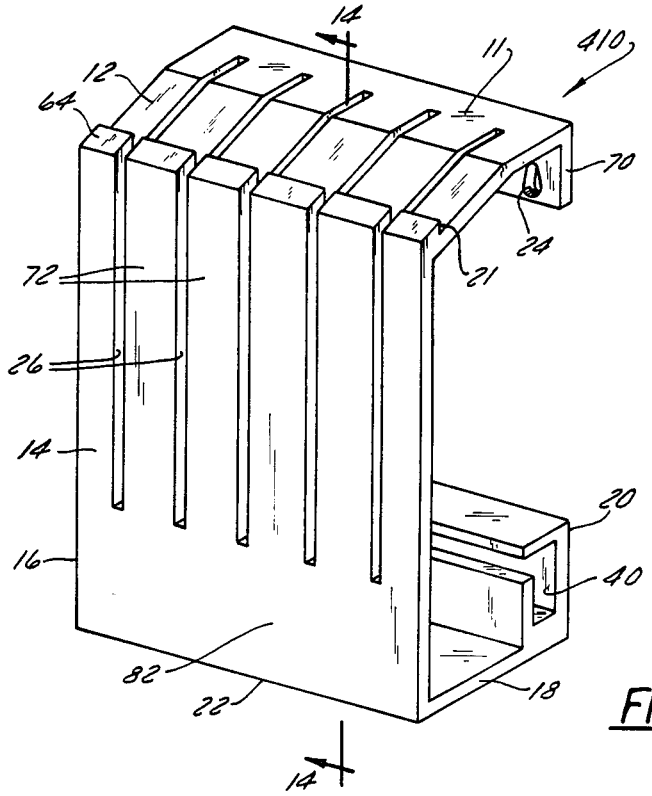
FIG. 13 is a perspective view of the front surface, upper surface and a side surface of a fourth embodiment of a knife holder in accordance with the invention.
Figure 14:
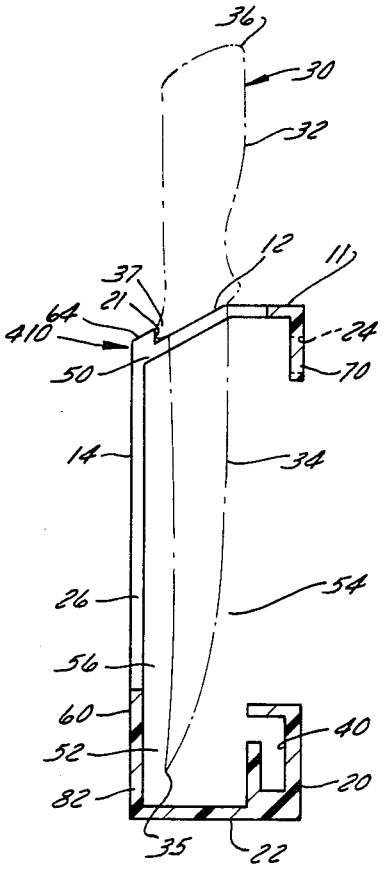
FIG. 14 is a cross-section view taken on line 14—14 of FIG. 13.

Referring to FIGS. 13 and 14, the numeral 410 designates a knife holder in accordance with a fourth embodiment of the present invention. Holder 410 comprises a body 11 having an upwardly sloped upper surface 12, a front surface 14 transverse to upper surface 12, opposite side surfaces 16 and 18, a rear surface 20 and a bottom surface 22.

Holder 410 comprises a plurality (five) of knife-blade receiving slots, such as slot 26, which extend inwardly from the upper surface 12 and front surface 14 and is thus able to releasably support a plurality (five) of knives, such as the knife 30 shown in FIG. 14.

Holder 410 also comprises an implement receiving slot 40 which extends inwardly from side surface 18 and is adapted to accommodate an implement or a portion thereof in supporting relationship, such as the closed blades 41 of a scissors 42 shown in FIG. 2.

Blade obstructing means 60 are provided near the lower slot end 52 of blade-receiving slot 26 in front of the interior slot portion 54 and at or near the exposed frontal slot portion 56.

Handle engagement means in the form of a projection 64 are provided adjacent the upper slot end 50 of blade-receiving slot 26 and near the edge 21 where the upper surface 12 and front surface 14 of body 11 meet or intersect.

The knife holder 410 shown in FIGS. 13 and 14 is shown as constructed of plastic which is molded to appropriate size and shape. Knife holder 410 comprises a back-plate 70 having an L-shaped groove or recess formed to define implement receiving slot 40. A series of six spaced apart segments 72 define five slots 26. A section of plastic 82 extends across the lower ends of the slots 26 to provide the blade obstructing means 60.

I claim:

1. As an article of manufacture, a knifeholder for removably supporting a plurality of knives, each knife comprising a blade having a predetermined width, a predetermined thickness and a predetermined length, and a handle which is thicker than said blade, said handle having a terminal end and an opposite end which is transversely sloped relative to the longitudinal axis of said blade, said blade having a predetermined length measured from the blade tip to the nearest part of said handle, said knife holder comprising:

an upper surface;

a lower surface;

a pair of side surfaces;

a front surface;

a rear surface;

said front and rear surfaces each being transverse to said upper, lower and side surfaces;

said upper surface sloping upwardly proceeding in the direction away from said front surface and toward said rear surface;

a plurality of blade-receiving slots, each blade-receiving slot extending uninterruptedly inwardly from said front surface for a distance greater than the predetermined width of a knife blade to be associated therewith and extending downwardly from said upper surface for a distance greater than the predetermined length of a knife blade to be associated therewith, each blade-receiving slot having an upper end near said upper surface and a lower end near said lower surface, each blade-receiving slot being thicker than the predetermined thickness of a knife blade to be associated therewith and narrower than a knife handle to be associated therewith;

handle-engaging means located near the upper end of each blade-receiving slot and comprising projections located on both sides of a slot adjacent said front surface and extending upwardly relative to said upper surface;

and a single blade obstructing means located nearer to said lower end than to said upper end of each slot adjacent said front surface, said blade obstructing means having an upper side spaced from said upper surface at a distance less than said predetermined length of a blade to be associated therewith.

2. An article of manufacture according to claim 1 including at least one implement-receiving slot extending axially inwardly from one of said side surfaces rearwardly of said blade-receiving slots to removably support an implement.

3. An article of manufacture according to claim 2 further including another implement-receiving slot extending axially inwardly from one of said side surfaces forward of said blade-receiving slots.

4. An article of manufacture according to claims 1 or 2 wherein said knife holder is fabricated of a single piece of material.

5. An article of manufacture according to claim 4 wherein said material is plastic.

6. An article of manufacture according to claims 1 or 2 wherein said knife holder is fabricated of a plurality of pieces of wood.

7. An article of manufacture according to claim 1 wherein said knife holder comprises a plurality of components which are rigidly secured together and comprising:

a back plate defining said rear surface;

block means secured to said back plate and defining said upper, lower, front and side surfaces and defining said handle-engaging means and defining said blade-receiving slots;

and means transverse to said slots defining said blade obstructing means.

8. An article of manufacture according to claim 7 wherein said block means comprises separate spaced apart blocks defining said slots and said means transverse to said slots comprises a strip.

9. An article of manufacture according to claim 8 wherein said block means comprises face plates attached to said blocks and defining said handle-engaging means.

10. An article of manufacture according to claim 7 wherein said block means comprises an upper block having cuts therein extending inwardly from said front surface to define upper portions of said slots, and wherein said block means further comprises a lower block having cuts therein extending outwardly from said rear surface toward said front surface to define lower portions of said slots.

* * * * *